United States Patent [19]

Jutte

[11] 4,094,152

[45] June 13, 1978

[54] APPARATUS FOR LAYING A PIPE LINE

[75] Inventor: Hans Jütte, Dortmund-Brechten, Germany

[73] Assignee: Gewerkschaft Eisenhutte Westfalia, Lunen, Germany

[21] Appl. No.: 791,487

[22] Filed: Apr. 27, 1977

[30] Foreign Application Priority Data

May 21, 1976 Germany ..... 2622671

[51] Int. Cl.[2] ..... E21D 5/12

[52] U.S. Cl. ..... 61/41 A; 61/85; 61/105

[58] Field of Search ..... 61/85, 84, 41 A, 105

[56] References Cited

U.S. PATENT DOCUMENTS 3,543,522 12/1970 Torti ..... 61/41 A 3,994,139 11/1976 Folk ..... 61/105

*Primary Examiner*—Jacob Shapiro

*Attorney, Agent, or Firm*—Thompson, Birch, Gauthier & Samuels

[57] ABSTRACT

Pipe-laying apparatus employs an advanceable shield with a set of elongate cutter planks supported for longitudinal displacement by a frame. Rams interconnect the planks and the frame and enable the shield to advance to form an open trench. Behind the shield is an open stabilizing frame connected with further adjusting rams to the frame of the drive shield. The frame serves to receive a pipe section which is to be aligned and connected to a previously-installed pipe section to extend the pipe line. A set of long follow-up planks are pivotably connected to the cutter planks and lie between the open frame and the trench walls. The follow-up planks extend over a distance equal to two or three times the length of the open frame and of the individual pipe sections to form a protection zone behind the open frame

7 Claims, 1 Drawing Figure

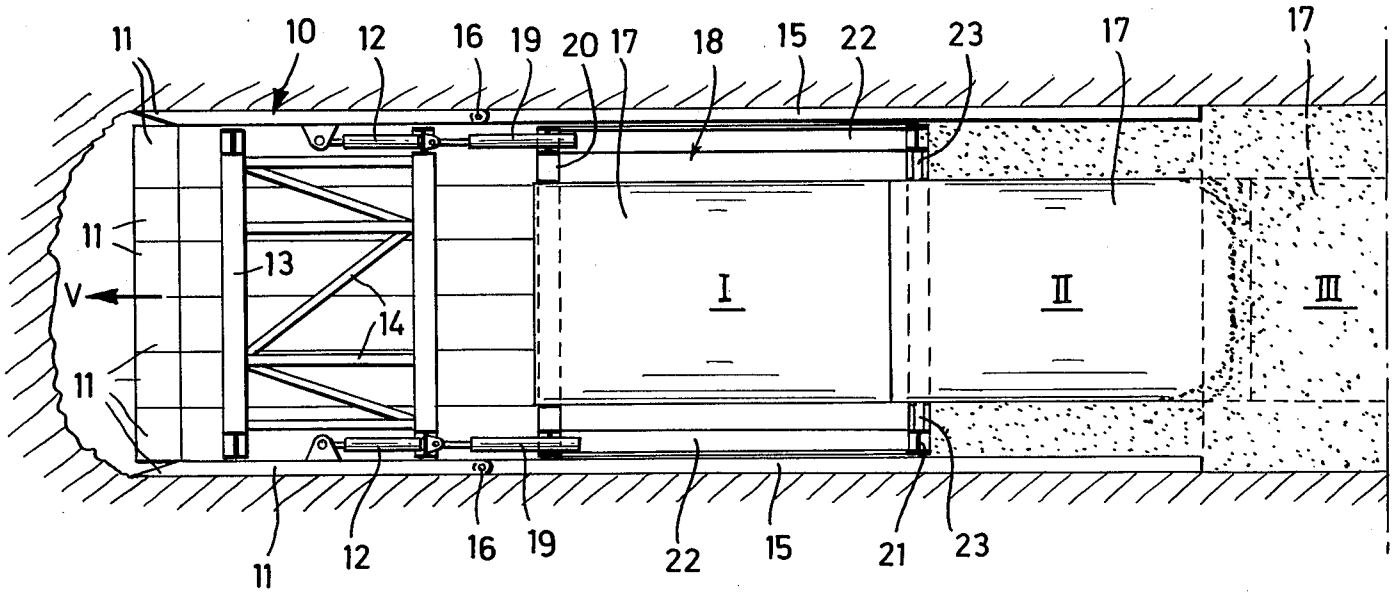
17
17
23
22
15
18
17
20
19
16
12
10
11
III
II
I
23
21
15
22
19
16
12
14
13
11
11
V
11

APPARATUS FOR LAYING A PIPE LINE

BACKGROUND TO THE INVENTION

The present invention relates to an apparatus for laying down a pipe line composed of individual pipe sections arranged end-to-end in an open trench.

A known apparatus is described in U.S. Pat. No. 3,994,139. This known apparatus is particularly useful in laying a pipe line in water bearing soil, and employs an advanceable drive shield excavating an open trench and a sealed receptacle for receiving the individual pipe sections. The receptacle is directly coupled to the frame of the drive shield and a series of supplementary elongate planks or members lie between the receptacle and the trench walls. These supplementary planks are pivoted to the cutter planks or drive members of the drive shield. The trench walls are unsupported behind the receptacle however and in certain cases this is a disadvantage since separate shoring sheets or planks may be needed to support the trench walls in the rear zone.

A general object of the present invention is to provide an improved apparatus of the aforementioned kind where the various operations, i.e., the trench driving, the pipe laying and the subsequent re-filling of the trench can be carried out largely independently of one another permitting the overall operation to proceed more rapidly.

SUMMARY OF THE INVENTION

In accordance with the invention a stabilizing frame serves as a pipe receptacle and is connected by adjustable means, such as hydraulic rams, to the frame of the drive shield and the supplementary members, which are disposed between the stabilizing frame and the trench walls, have a considerable length say two to three times greater than the length of a pipe section. The frame itself may have a length approximately the same or just slightly greater than the length of a pipe section so that the supplementary members extend beyond the frame to the rear to define a protective zone where the trench re-filling occurs. The supplementary members and the drive members of the shield can thus collectively extend over the entire trench from the working face through the pipe-laying region to the re-filled trench.

The adjustable means between the frame of the drive shield and the rear frame enables the frame of the drive shield to be advanced independently of the other rear stabilizing shield so that the excavating work need not be halted until the pipe-laying operation has been completed. At all times however the trench walls are reliably supported. The stabilizing frame and the supplementary members can be designed so that the frame supports the supplementary members adequately so that despite their length and even in the case of high wall pressures no significant lateral movement of the members occurs.

Preferably the rear or stabilizing frame is an open structure with rigid frame parts or components spaced apart along the trench and interconnected by bracing struts or the like. Preferably the frame also has a bulkhead at its rear end permitting the pipe section received therein to be aligned into contact with a previously installed pipe section at the end of the pipe line and preventing in-filling material used to bury the pipe line from entering the frame.

An apparatus made in accordance with the invention may comprise an advanceable shield for excavating an open trench and for supporting the walls thereof, said shield being composed of a plurality of longitudinally displaceable elongate drive members, frame means for supporting and guiding the drive members and ram means for effecting relative movement between the frame means and the drive members to effect advancement of the trench, supplementary elongate members connected to the drive members for supporting the trench walls rearwardly of the shield, an open frame supporting the supplementary members and serving to receive the individual pipe sections and adjustable means connecting said open frame to the frame means, wherein the length of the supplementary members is substantially greater than the length of the open frame so as to extend rearwardly thereof and the length of the supplementary members is at least twice the length of one of the pipe sections.

The invention may be understood more readily and various other features of the invention may become apparent from consideration of the following description.

BRIEF DESCRIPTION OF DRAWING

An embodiment of the invention will now be described, by way of example only, with reference to the accompanying drawing which is a diagrammatic sectional plan view of apparatus made in accordance with the invention.

DESCRIPTION OF PREFERRED EMBODIMENT

In general, a composite pipe line is composed of individual pipe sections 17 arranged end-to-end and installed with the aid of the apparatus made in accordance with the invention. The apparatus excavates an open trench into which the pipe sections are laid and as the pipe laying proceeds the installed pipe sections are covered by a filling material which refills the trench.

To excavate the trench in advance of the actual pipe laying the apparatus uses a drive or knife shield 10 which defines the shape of the trench and also supports the side walls of the trench in the forward region. The shield 10 is composed of a plurality of parallel elongate drive members or planks 11 arranged side-by-side in contact with the trench side walls and floor. The members 11, which have cutting edges at their front ends to penetrate the soil, are supported and guided by a frame 13 which is here composed of two spaced ring components linked by horizontal and diagonal struts 14. The members 11 can be thrust forwards in the advancing direction V, either individually or in groups, with the aid of double acting hydraulic rams 12 supported by the rear ring component of the frame 13. In this construction each member 11 is coupled to a respective one of the rams 12. The general construction and operation of the shield 10 is known per se.

A set of supplementary elongate support members 15 are provided rearwardly of the shield 10. Each member 15 is coupled to a respective one of the members 11 with the aid of a pivot joint 16 so that each member 15 will be drawn up to follow the advancement of its associated member 11. The members 15 are considerably longer than the members 11 and preferably the length of the members 15 is approximately two to three times the length of one of the pipe sections 17.

A further stabilizing frame 18 is arranged within the members 15 behind the shield 10. The frame 18 is coupled to the frame 13 with the aid of hydraulic rams 19. The frame 18 is open to the top of the trench and composed of rigid U-shaped parts 20, 21 spaced apart by a distance approximating to the length of one of the pipe sections 17 and interconnected by bracing means in the form of struts 22 or the like. The frame 18 externally supports the members 15 and is slidably guided thereby. The frame 18 also serves as a receptacle for receiving the individual pipe sections 17. The pipe sections 17 can be supported directly by the parts 20, 21 or by additional support means arranged thereon. The rear part 21 of the frame 18 preferably supports a bulkhead 23 or the like permitting the passage of the pipe sections 17 as the pipe-laying progresses while preventing soil in zone II from entering the frame 18 in zone I.

The zone I is the region where one of the pipe sections 17 is lowered into the frame 18 to align with the previously-installed pipe section 17 in zone II. This previously-installed pipe section 17 in zone II is here represented as being covered with a filling material, such as the soil previously excavated and lies within the members 15 whereas the next adjacent pipe section 17 in zone III is outside the members 15 and lies in the now completely refilled trench.

Since the frame 18 is connected to the frame 13 with the rams 19 the driving and excavating work at the forward part of the trench can take place more-or-less continuously and independently of the pipe-laying work.

I claim:

1. An apparatus for use in laying a pipe line composed of individual pipe sections arranged end-to-end; said apparatus comprising an advanceable shield for excavating an open trench and for supporting the walls thereof, said shield being composed of a plurality of longitudinally displaceable elongate drive members, frame means for supporting and guiding the drive members and ram means for effecting relative movement between the frame means and the drive members to effect advancement of the trench, supplementary elongate members connected to the drive members for supporting the trench walls rearwardly of the shield, an open frame supporting the supplementary members and serving to receive the individual pipe sections and adjustable means for connecting said open frame to the frame means and for effecting relative displacement therebetween, wherein the length of the supplementary members is substantially greater than the length of the open frame so as to extend rearwardly thereof and the length of the supplementary members is at least twice the length of one of the pipe sections.

2. An apparatus according to claim 1, wherein the open frame has a length which is approximately the same as the length of one of the pipe sections introduced therein.

3. An apparatus according to claim 1, wherein the open frame supports the pipe section received therein for extending the pipe line and the open frame is composed of rigid parts spaced apart along the trench and interconnected by bracing means.

4. An apparatus according to claim 3, wherein the open frame also has a bulkhead at its rear end permitting the pipe section received therein to be aligned into contact with a previously-installed pipe section at the end of the pipe line and preventing in-filling material used to bury the pipe line from entering the frame.

5. An apparatus according to claim 1, wherein the supplementary members are pivotably connected to the drive members.

6. Apparatus for use in laying a pipe line composed of a series of pipe sections arranged end-to-end; said apparatus comprising an advanceable drive shield for excavating an open trench and for supporting the walls thereof, said shield being composed of a plurality of elonage drive members arranged in side-by-side relationship, a frame supporting and guiding the drive members for longitudinal displacement and hydraulic rams for effecting relative movement between the drive members and the frame to advance the trench, a further frame disposed rearwardly of the drive shield for receiving and supporting a pipe section extending the pipe line, hydraulic rams connecting the frame of the drive shield to said further frame, a set of elongate support members each connected to follow up one of the drive members of the drive shield, the further frame supporting the support members against the trench walls, wherein the support members have a length substantially greater than that of the further frame so as to extend rearwardly thereof to define a zone where the pipe line can be covered by filling material.

7. An apparatus for use in laying a pipe line composed of individual pipe sections arranged end-to-end; said apparatus comprising an advanceable shield for excavating an open trench and for supporting the walls thereof, said shield being composed of a plurality of longitudinally displaceable elongate drive members, frame means for supporting and guiding the drive members and ram means for effecting relative movement between the frame means and the drive members to effect advancement of the trench, supplementary elongate members connected to the drive members for supporting the trench walls rearwardly of the shield, an open frame supporting the supplementary members and serving to receive the individual pipe sections and hydraulic rams connecting said open frame to the frame means, wherein the length of the supplementary members is substantially greater than the length of the open frame so as to extend rearwardly thereof and the length of the supplementary members is at least twice the length of one of the pipe sections.

* * * * *